US009662531B2

(12) United States Patent
Giannelli et al.

(10) Patent No.: US 9,662,531 B2
(45) Date of Patent: May 30, 2017

(54) ARM CURL EXERCISE APPARATUS

(71) Applicant: Cybex International, Inc., Medway, MA (US)

(72) Inventors: Raymond Giannelli, Franklin, MA (US); Mark Buontempo, Millville, MA (US)

(73) Assignee: Cybex International, Inc., Medway, MA (US)

( * ) Notice: Subject to any disclaimer, the term of this patent is extended or adjusted under 35 U.S.C. 154(b) by 37 days.

(21) Appl. No.: 14/989,123

(22) Filed: Jan. 6, 2016

(65) Prior Publication Data

US 2016/0114210 A1 Apr. 28, 2016

Related U.S. Application Data

(63) Continuation of application No. PCT/US2015/019848, filed on Mar. 11, 2015.

(Continued)

(51) Int. Cl.
*A63B 23/12* (2006.01)
*A63B 21/078* (2006.01)

(Continued)

(52) U.S. Cl.
CPC ..... *A63B 21/078* (2013.01); *A63B 21/00065* (2013.01); *A63B 21/00076* (2013.01); *A63B 21/0083* (2013.01); *A63B 21/0087* (2013.01); *A63B 21/0407* (2013.01); *A63B 21/062* (2013.01); *A63B 21/063* (2015.10); *A63B 21/0628* (2015.10); *A63B 21/152* (2013.01); *A63B 21/154* (2013.01); *A63B 21/159* (2013.01); *A63B 21/4035* (2015.10); *A63B 21/4047* (2015.10); *A63B 23/0205* (2013.01); *A63B 23/0211* (2013.01);

(Continued)

(58) Field of Classification Search
USPC ..... 482/93–107
See application file for complete search history.

(56) References Cited

U.S. PATENT DOCUMENTS 5,967,954 A * 10/1999 Habing ..... A63B 21/159 482/100
7,331,911 B2 * 2/2008 Webber ..... A63B 21/4047 482/100

(Continued)

OTHER PUBLICATIONS

Written Opinion of the IPEA mailed Feb. 25, 2016 in corresponding Int'l. Appln. No. PCT/US2015/019848.
Response to Written Opinion of Feb. 25, 2016 filed May 4, 2016 with the European Patent Office in corresponding Int'l. Appln. No. PCT/US2015/019848.
Int'l. Search Report and Written Opinion mailed May 8, 2015 in corresponding Int'l. Appln. No. PCT/US2015/019848.

(Continued)

*Primary Examiner* — Stephen Crow
(74) *Attorney, Agent, or Firm* — Polsinelli PC

(57) ABSTRACT

Apparatus (10) for performing an arm curl exercise comprising:
a frame (12),
a seat (16),
an elbow pad (19)
an input arm assembly (24) interconnected to a resistance mechanism (42) and a manually graspable mechanism (**30*h***),
the seat (16) being arranged relative to the input arm assembly (24) to position the user in a user start position (USP) that enables the user to manually engage the manually graspable mechanism (**30*h*) with a posterior surface (PSE) of the user's elbow user's elbow (13*e*) engaged with the engaging surface (ES) of the elbow pad (19**),
the input arm assembly comprising a first arm (**30*r*) and a second arm (30*f***) pivotable around a first linear axis (AA).

20 Claims, 9 Drawing Sheets

Related U.S. Application Data

(60) Provisional application No. 61/951,059, filed on Mar. 11, 2014, provisional application No. 61/951,046, filed on Mar. 11, 2014, provisional application No. 61/951,011, filed on Mar. 11, 2014, provisional application No. 61/951,026, filed on Mar. 11, 2014, provisional application No. 61/951,034, filed on Mar. 11, 2014.

(51) Int. Cl.

| | |
|---|---|
| ***A63B 21/00*** | (2006.01) |
| ***A63B 23/02*** | (2006.01) |
| ***A63B 21/062*** | (2006.01) |
| ***A63B 21/008*** | (2006.01) |
| ***A63B 21/04*** | (2006.01) |
| ***A63B 23/035*** | (2006.01) |
| *A63B 21/02* | (2006.01) |
| *A63B 21/005* | (2006.01) |
| *A63B 21/012* | (2006.01) |
| *A63B 21/055* | (2006.01) |

(52) U.S. Cl.

CPC ..... *A63B 23/0233* (2013.01); *A63B 23/035* (2013.01); *A63B 23/03525* (2013.01); *A63B 23/1209* (2013.01); *A63B 23/1281* (2013.01); *A63B 21/005* (2013.01); *A63B 21/0088* (2013.01); *A63B 21/012* (2013.01); *A63B 21/023* (2013.01); *A63B 21/0552* (2013.01); *A63B 2208/0228* (2013.01); *A63B 2208/0233* (2013.01); *A63B 2208/0238* (2013.01)

(56) References Cited

U.S. PATENT DOCUMENTS

| | | | | |
|---|---|---|---|---|
| 7,563,214 | B2 * | 7/2009 | Webber | A63B 21/155 482/100 |
| 7,594,880 | B2 * | 9/2009 | Webber | A63B 21/0628 482/95 |
| 7,670,269 | B2 * | 3/2010 | Webber | A63B 21/159 434/29 |
| 7,794,371 | B2 * | 9/2010 | Webber | A63B 21/0615 482/95 |
| 7,901,335 | B2 * | 3/2011 | Webber | A63B 21/0615 482/140 |
| 7,938,760 | B1 * | 5/2011 | Webber | A63B 21/00181 482/137 |
| 7,955,234 | B1 * | 6/2011 | Pursley | A63B 21/0083 482/112 |
| 7,993,251 | B1 * | 8/2011 | Webber | A63B 21/0615 482/100 |
| 8,113,996 | B1 * | 2/2012 | Allen | A63B 21/0088 482/57 |
| 2003/0171193 | A1 | 9/2003 | Deola | |
| 2010/0016128 | A1 | 1/2010 | Webber et al. | |
| 2016/0114207 | A1 * | 4/2016 | Giannelli | A63B 21/078 482/98 |

OTHER PUBLICATIONS

Response to Written Opinion of May 8, 2015 filed Jan. 26, 2016 with the European Patent Office in corresponding Int'l. Appln. No. PCT/US2015/019848.

Int'l. Search Report and Written Opinion from priority application PCT/US2015/019848.

* cited by examiner

ARM CURL EXERCISE APPARATUS

RELATED APPLICATIONS

This application is a continuation of PCT/US2015/019848, filed Mar. 11, 2015 which claims the benefit of priority to U.S. Provisional Application No. 61/951,011 filed Mar. 11, 2014 and U.S. Provisional Application No. 61/951,059 filed Mar. 11, 2014 and U.S. Provisional Application No. 61/951,026 filed Mar. 11, 2014 and U.S. Provisional Application No. 61/951,034 filed Mar. 11, 2014 and U.S. Provisional Application No. 61/951,046 filed Mar. 11, 2014 the disclosures of all of which are incorporated herein by reference in their entirety as if fully set forth herein This application incorporates by reference the disclosures of all of the following in their entirety as if fully set forth herein: U.S. Pat. No. 7,666,123, U.S. Pat. No. 7,717,831, U.S. Pat. No. 4,725,054, U.S. Pat. No. 8,070,658, U.S. Pat. No. 7,278,955, U.S. Pat. No. 8,025,609, U.S. Pat. No. 7,727,128, U.S. Pat. No. D486,535, U.S. Pat. No. D490,127, U.S. Patent Publication No. 2003/0092541, U.S. Patent Publication No. 2007/0173384, U.S. Patent Publication No. 2006/0270531, U.S. Patent Publication No. 2008/0167169, U.S. Patent Publication No. 2010/0204021.

FIELD OF THE INVENTION

The present invention relates to physical exercise machines and more particularly to an exercise apparatus that enables users to perform an arm curl exercise that is resisted by a resistance mechanism.

BACKGROUND OF THE INVENTION

Exercise machines for exercising bicep muscles are known where the user is forced to engage a handle that rotates forcing the user to exert force via wrist and muscles other than the biceps.

SUMMARY OF THE INVENTION

The state of the art for weight machines for training the biceps muscles in an arm curl pattern is primarily centered in two different configurations. One method is a cable based exercise where there is either a single resistive cable and handle or dual resistive cables with handles for each. The cable allows for varying patterns to be created and cover a wide variety of user sizes without adjustments to the machine. The second method is to have either a fixed or rotating grip on the end of a resisted arm, typically with an axis of rotation that is coincident with the axis of rotation of the elbow. This arm based method allows for a variety of grip positions during the movement of elbow flexion. This is important in biceps training since rotation of the wrist during the flexion exercise affects the length of the biceps and will affect the outcome. Aside from the benefits listed above, each method also has subsequent limitations. The limitation of the cable based method is it does not allow the grip to rotate in multiple planes of motion. This does not afford the supination/pronation opportunity at the wrist to allow for maximum length change of the biceps during arm flexion and therefore is not a preferred method. The single axis arm method does allow for wrist movement but does not afford the variability in the movement pattern to fit different sized and shaped individuals without significant adjustments. It also does not allow the user to choose their own user defined path of motion since a single axis machine primarily accomplishes a machine defined path of motion. An apparatus and method according to the invention has the benefit of a variable path of motion that the cable based machine offers in addition to allowing the wrist to supinate and pronate (rotate around the longitudinal axis of the forearm) without additional stresses being placed on the wrist. A method and apparatus according to the invention employs at least: a two link arm that has a fixed pivot behind the user and a dual axis pivot at its elbow. This allows the arm to move in any direction the user desires to complete the arm flexion exercise. The present method and apparatus of the invention also automatically adjusts to the users arm length due to the fact that arm is not loaded around a single pivot but instead has two links. Because the forward link cannot rotate around its longitudinal axis, the invention allows for a multi axis grip that affords any wrist position without subsequent adverse torque reactions at the wrist. Resistive load is accomplished via a cable attached to the end of the second link, directly in line with the rotating grip without interfering with said grip. This allows for the preferred loading characteristics of a cable resistance with the multiple grip orientations afforded by a fixed arm machine.

In accordance with the invention there is provided an apparatus (10) for performing an arm curl exercise by a user (5) having a trunk (T1) having a longitudinal axis (LA), opposing anterior (AS) and posterior (PS) sides and arms (13) with elbows (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted on the frame for back and forth travel along a generally upward (UW) to downward (DW) and forward (FW) to rearward (RW) direction, the input arm assembly (24) being adapted to reside in a start motionless position (SMP) relative to a selected arrangement of the seat (16) and elbow pad (19), the seat (16) being arranged relative to the input arm assembly (24) to position the user in a user start position (USP) that enables the user to manually engage the manually graspable mechanism (30*h*) when the user is seated in an orientation where a posterior surface (PSE) of the user's elbow user's elbow (13*e*) is engaged with the engaging surface (ES) of the elbow pad (19) and the anterior side of the user's trunk is oriented in a generally forward (FW) direction, the input arm assembly comprising a first arm (30*r*) being rotatably pivotable around a first linear axis (AA) starting from the start exercise position (SEP) through a generally forward to rearward or downward to upward path of travel under resistance (R1) exerted by the resistance mechanism on application of upwardly or rearwardly directed force (RUF) by the user (5) on the manually graspable mechanism (30*h*), the input arm assembly comprising a second arm (30*f*) rotatably pivotable around a second linear axis (AAA) along a generally forward to rearward or downward to upward path of travel under resistance (R1) exerted by the resistance mechanism on application of upwardly or rearwardly directed force (RUF) by the user (5) on the manually graspable mechanism (30*h*).

The seat (16), elbow pad (19) and arm assembly (24) are preferably arranged on the apparatus such that the first linear axis (AA) of pivoting of the arms (30*f*, 30*r*) is disposed rearwardly (RW) of the user's trunk (T1) when the user is seated on the seating surface (S) and the posterior surface (PSE) of the user's elbow (13*e*) is engaged with the engaging surface (ES).

The second arm (30*f*) is preferably pivotable around a third linear axis (Z) along a generally lateral or side to side (SS) path of travel.

The second arm (30*f*) is preferably pivotable around the third linear axis (Z) under resistance (R1*a*) exerted by the resistance mechanism on application of generally laterally directed force (LF) by the user on the manually graspable mechanism (30*h*) starting from the start exercise position (SEP).

The manually graspable mechanism can comprise a handle link 301 pivotably mounted to the second arm (30*f*) for separate rotation around a handle axis (Y).

The manually graspable mechanism can include a grip (30*hg*) pivotably mounted to the handle link (301) for separate rotation around a grip axis (YY).

The input arm assembly (24) can be interconnected to the resistance mechanism (42) at a point of interconnection (30*de*) of the input arm assembly that is spaced a first selected orthogonal distance (FOD) apart from the first linear axis (AA) selected to create a first selected torque resistance from the resistance mechanism against forward (FW) to rearward (RW) movement of the input arm assembly and is spaced a second selected orthogonal distance (SOD) from the third linear axis (Z) selected to create a second selected torque resistance from the resistance mechanism against lateral or side to side (SS) movement of the second arm (30*f*).

The first selected orthogonal distance is typically greater than the second selected orthogonal distance.

The first selected orthogonal distance is typically greater than or equal to about 9 inches and the second selected orthogonal distance is greater than or equal to about 3 inches.

The first linear axis (AA) and second linear axis (AAA) are typically disposed generally parallel relative to each other.

The first linear axis (AA) and the third linear axis (Z) are typically disposed generally orthogonal to each other.

The second linear axis (AAA) and the third linear axis (Z) are typically disposed generally orthogonal to each other.

The input arm assembly (24) is preferably adapted such that in the start motionless position (SMP) the manually graspable mechanism (30*h*) is disposed in a start exercise position (SEP) vertically below and forwardly of a point of engagement (PSE) of the user's elbow (13*e*) with the engaging surface (ES) when the user is seated on the seating surface (S) in an orientation where the anterior surface (AS) of the user's trunk (T1) is facing generally forwardly (FW).

The first arm (30*r*) is typically interconnected to a bracket (30*rb*) that pivots around the second linear axis (AAA) on a first axle (30*ra*), the first axle (30*ra*) being attached to a second axle (30*fa*) that is attached to the second arm (30*f*) and pivots about the third linear axis (Z) on a second bracket (30*fb*)

The first axle is preferably fixedly interconnected to the second axle.

In another aspect of the invention there is provided a method of performing an arm curl exercise comprising:

a user being seated on the seat of the exercise apparatus described above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a rearwardly or upwardly directed force (RUF) on the manually graspable mechanism against resistance from the resistance mechanism.

In another aspect of the invention there is provided a method of performing a pull down exercise comprising:

a user being seated on the seat of the exercise apparatus described above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a laterally or side to side directed force (LF) on the manually graspable mechanism against resistance from the resistance mechanism.

In another aspect of the invention there is provided an apparatus (10) for performing a pull down exercise by a user (5) having a trunk (T1) having a longitudinal axis (LA), opposing anterior (AS) and posterior (PS) sides and arms (13) with elbows (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted on the frame for back and forth travel along a generally upward (UW) to downward (DW) and forward (FW) to rearward (RW) direction, the input arm assembly (24) being adapted to reside in a start motionless position (SMP) relative to a selected arrangement of the seat (16) and elbow pad (19) that disposes the manually graspable mechanism (30*h*) in a start exercise position (SEP) that is disposed vertically below and forwardly of the user's trunk (T1) when the user is seated on the seating surface (S) in an orientation where the anterior surface (AS) of the user's trunk (T1) is facing generally forwardly (FW), the seat (16) being arranged relative to the input arm assembly (24) to position the user in a user start position (USP) that enables the user to manually engage the manually graspable mechanism (30*h*) when the user is seated in an orientation where a posterior surface (PSE) of the user's elbow user's elbow (13*e*) is engaged with the engaging surface (ES) of the elbow pad (19) and the anterior and posterior sides of the user's trunk are oriented in a generally forward (FW) to rearward (RW) direction, the input arm assembly comprising a first arm (30*r*) being rotatably pivotable around a first linear axis (AA) starting from the start exercise position (SEP) through a generally forward to rearward or downward to upward path of travel under resistance (R1) exerted by the resistance mechanism on application of upwardly or rearwardly directed force (RUF) by the user (5) on the manually graspable mechanism (30*h*), the input arm assembly comprising a second arm (30*f*) pivotable around a third linear axis (Z) along a generally lateral or side to side (SS) path of travel.

The seat (16), elbow pad (19) and arm assembly (24) are preferably arranged on the apparatus such that the first linear axis (AA) of pivoting of the arms (30*f*, 30*r*) is disposed rearwardly (RW) of the user's trunk (T1) when the user is seated on the seating surface (S) and the posterior surface (PSE) of the user's elbow (13*e*) is engaged with the engaging surface (ES).

The second arm (30*f*) is typically pivotable around a second linear axis (AAA) along a generally forward to rearward or downward to upward path of travel under resistance (R1) exerted by the resistance mechanism on application of upwardly or rearwardly directed force (RUF) by the user (5) on the manually graspable mechanism (30*h*).

The second arm (30*f*) is preferably pivotable around the third linear axis (Z) under resistance (R1*a*) exerted by the resistance mechanism on application of generally laterally directed force (LF) by the user on the manually graspable mechanism (30*h*) starting from the start exercise position (SEP).

The manually graspable mechanism preferably comprises a handle link 301 pivotably mounted to the second arm (30*f*) for separate rotation around a handle axis (Y).

The manually graspable mechanism preferably includes a grip (30*hg*) pivotably mounted to the handle link (30I) for separate rotation around a grip axis (YY).

The input arm assembly (24) is typically interconnected to the resistance mechanism (42) at a point of interconnection (30*de*) of the input arm assembly that is spaced a first selected orthogonal distance (FOD) apart from the first linear axis (AA) selected to create a first selected torque resistance from the resistance mechanism against forward (FW) to rearward (RW) movement of the input arm assembly and is spaced a second selected orthogonal distance (SOD) from the third linear axis (Z) selected to create a second selected torque resistance from the resistance mechanism against lateral or side to side (SS) movement of the second arm (30*f*).

The first selected orthogonal distance is preferably greater than the second selected orthogonal distance.

The first selected orthogonal distance is preferably greater than or equal to about 9 inches and the second selected orthogonal distance is preferably greater than or equal to about 3 inches.

The first linear axis (AA) and second linear axis (AAA) are typically disposed generally parallel relative to each other.

The first linear axis (AA) and the third linear axis (Z) are preferably disposed generally orthogonal to each other.

The second linear axis (AAA) and the third linear axis (Z) are preferably disposed generally orthogonal to each other.

The seat is typically selectively adjustable in vertical position relative to the manually graspable mechanism.

In another aspect of the invention there is provided a method of performing an arm curl exercise comprising:

a user being seated on the seat of the exercise apparatus of the apparatus described immediately above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a rearwardly or upwardly directed force (RUF) on the manually graspable mechanism against resistance from the resistance mechanism.

In another aspect of the invention there is provided a method of performing a pull down exercise comprising:

a user being seated on the seat of the exercise apparatus described immediately above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a laterally or side to side directed force (LF) on the manually graspable mechanism against resistance from the resistance mechanism.

Apparatus (10) for performing a pull down exercise by a user (5) having a trunk (T1) having a longitudinal axis (LA), opposing anterior (AS) and posterior (PS) sides and arms (13) with elbows (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted on the frame for back and forth travel along a generally upward (UW) to downward (DW) and forward (FW) to rearward (RW) direction, the input arm assembly (24) being adapted to reside in a start motionless position (SMP) relative to a selected arrangement of the seat (16) and elbow pad (19) that disposes the manually graspable mechanism (30*h*) in a start exercise position (SEP) that is disposed vertically below and forwardly of the user's trunk (T1) when the user is seated on the seating surface (S) in an orientation where the anterior surface (AS) of the user's trunk (T1) is facing generally forwardly (FW), the seat (16) being arranged relative to the input arm assembly (24) to position the user in a user start position (USP) that enables the user to manually engage the manually graspable mechanism (30*h*) when the user is seated in an orientation where a posterior surface (PSE) of the user's elbow user's elbow (13*e*) is engaged with the engaging surface (ES) of the elbow pad (19) and the anterior and posterior sides of the user's trunk are oriented in a generally forward (FW) to rearward (RW) direction, the input arm assembly comprising a first arm (30*r*) being rotatably pivotable around a first linear axis (AA) starting from the start exercise position (SEP) through a generally forward to rearward or downward to upward path of travel under resistance (R1) exerted by the resistance mechanism on application of upwardly or rearwardly directed force (RUF) by the user (5) on the manually graspable mechanism (30*h*), wherein the manually graspable mechanism comprises a handle link (301) pivotably mounted to the input arm assembly (24) for separate rotation around a handle axis (Y).

The manually graspable mechanism (30*h*) includes a grip (30*hg*) pivotably mounted to the handle link (301) for separate rotation around a grip axis (YY).

The input arm assembly preferably comprises a second arm (30*f*) rotatably pivotable around the first linear axis (AA) and a second linear axis (AAA) along a generally forward to rearward or downward to upward path of travel under resistance (R1) exerted by the resistance mechanism on application of upwardly or rearwardly directed force (RUF) by the user (5) on the manually graspable mechanism (30*h*).

The seat (16), elbow pad (19) and arm assembly (24) are typically arranged on the apparatus such that the first linear axis (AA) of pivoting of the arms (30*f*, 30*r*) is disposed rearwardly (RW) of the user's trunk (T1) when the user is seated on the seating surface (S) and the posterior surface (PSE) of the user's elbow (13*e*) is engaged with the engaging surface (ES).

The second arm (30*f*) is preferably pivotable around a third linear axis (Z) along a generally lateral or side to side (SS) path of travel.

The second arm (30*f*) is pivotable around the third linear axis (Z) under resistance (R1*a*) exerted by the resistance mechanism on application of generally laterally directed force (LF) by the user on the manually graspable mechanism (30*h*) starting from the start exercise position (SEP).

The input arm assembly (24) is interconnected to the resistance mechanism (42) at a point of interconnection (30*de*) of the input arm assembly that is spaced a first selected orthogonal distance (FOD) apart from the first linear axis (AA) selected to create a first selected torque resistance from the resistance mechanism against forward (FW) to rearward (RW) movement of the input arm assembly and is spaced a second selected orthogonal distance (SOD) from the third linear axis (Z) selected to create a second selected torque resistance from the resistance mechanism against lateral or side to side (SS) movement of the second arm (30*f*).

The first selected orthogonal distance is greater than the second selected orthogonal distance.

In another aspect of the invention there is provided a method of performing an arm curl exercise comprising:

a user being seated on the seat of the exercise apparatus described immediately above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a rearwardly or upwardly directed force (RUF) on the manually graspable mechanism against resistance from the resistance mechanism.

In another aspect of the invention there is provided a method of performing a pull down exercise comprising:

a user being seated on the seat of the exercise apparatus described above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a laterally or side to side directed force (LF) on the manually graspable mechanism against resistance from the resistance mechanism.

In another aspect of the invention there is provided an apparatus for performing an arm curl exercise by a user comprising:

a frame, a seat mounted on the frame in a position relative to the ground such that a user can sit on the seat with the user's feet touching the ground, a back rest mounted to the frame relative to the seat such that the user can engage the user's back against the back rest when seated on the seat, a pair of elbow pads mounted to the frame laterally relative to the backrest in an arrangement and adapted such that a user seated on the seat can engage the posterior surface of the user's elbows against the elbow pads when seated, an input arm assembly comprised of a pair of pivotable arms having a pair of grips or handles mounted to a distal end of the pivotable arms, the arms being mounted and adapted to dispose the grips or handles in a starting or rest position forwardly and below the point of engagement of the user's elbows with the elbow pads, the arms having a first arm portion pivotable around a first axis and second portion pivotable around a second axis generally perpendicular to the first axis, the arms being connected to a non-rotating portion of a distal end of the arms to a manually selectively adjustable weight resistance mechanism, the grips or handles being rotatably mounted on the distal end of the arms interconnected to the resistance mechanism through the non-rotating portion of the distal end of the arms.

The non-rotating portion of the distal end of the arms is preferably connected to one end of a cable and another end of the cable is interconnected to the resistance mechanism.

The seat, the back rest and the elbow pads are preferably fixedly mounted to the frame and do not require adjustment by a user regardless of size, shape or configuration of the user.

The first arm portion of the arms is pivotably mounted to the frame at an acute angle relative to horizontal of between about 20 degrees and about 75 degrees.

BRIEF DESCRIPTION OF THE DRAWINGS

The above and further advantages of the invention may be better understood by referring to the following description in conjunction with the accompanying drawings in which.

DETAILED DESCRIPTION

Figure 1:
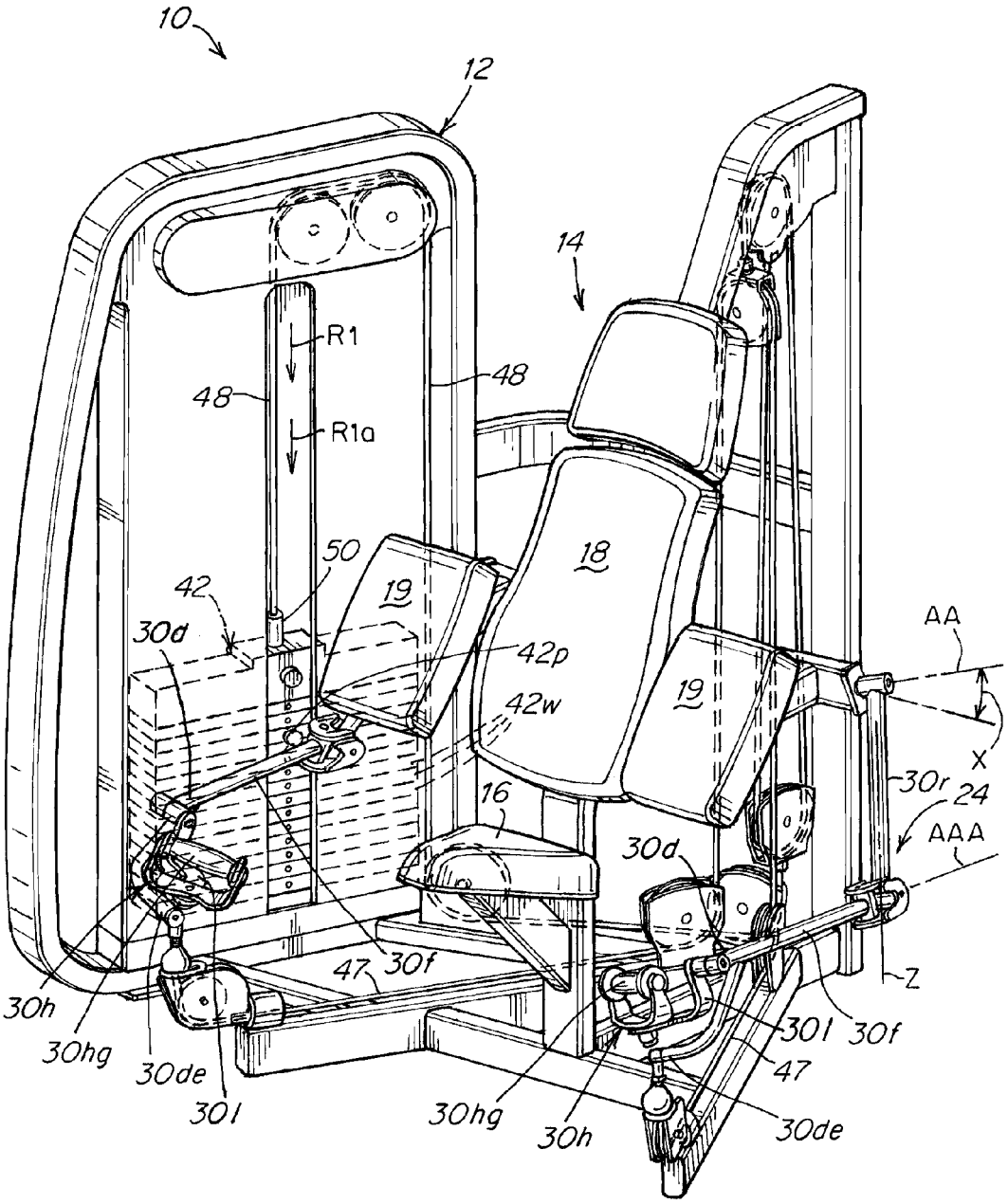
FIG. 1 is a front left side perspective view of an arm curl exercise apparatus according to the invention.
Figure 2:
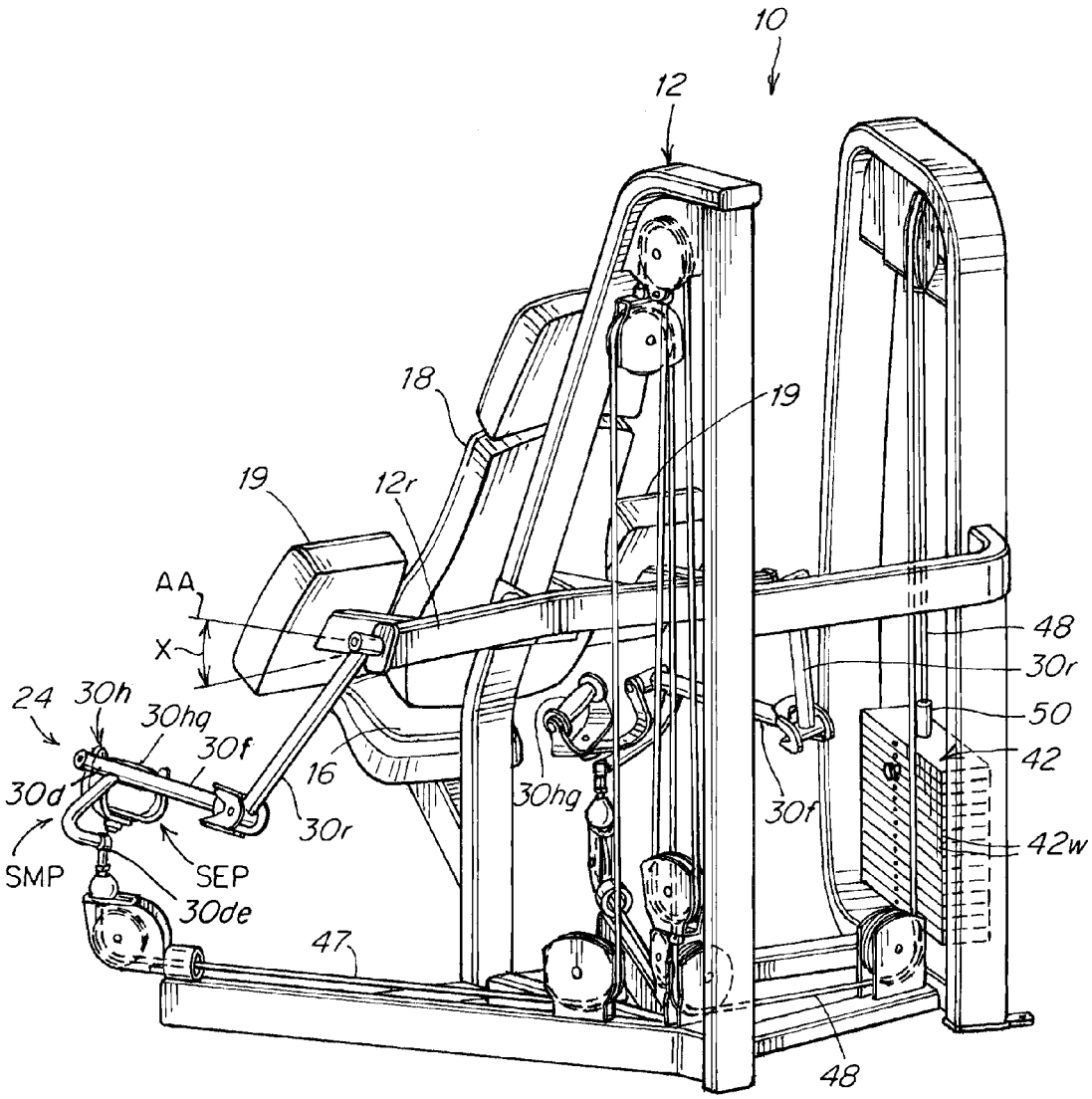
FIG. 2 is a rear left side perspective view of the FIG. 1 apparatus.
Figure 3:
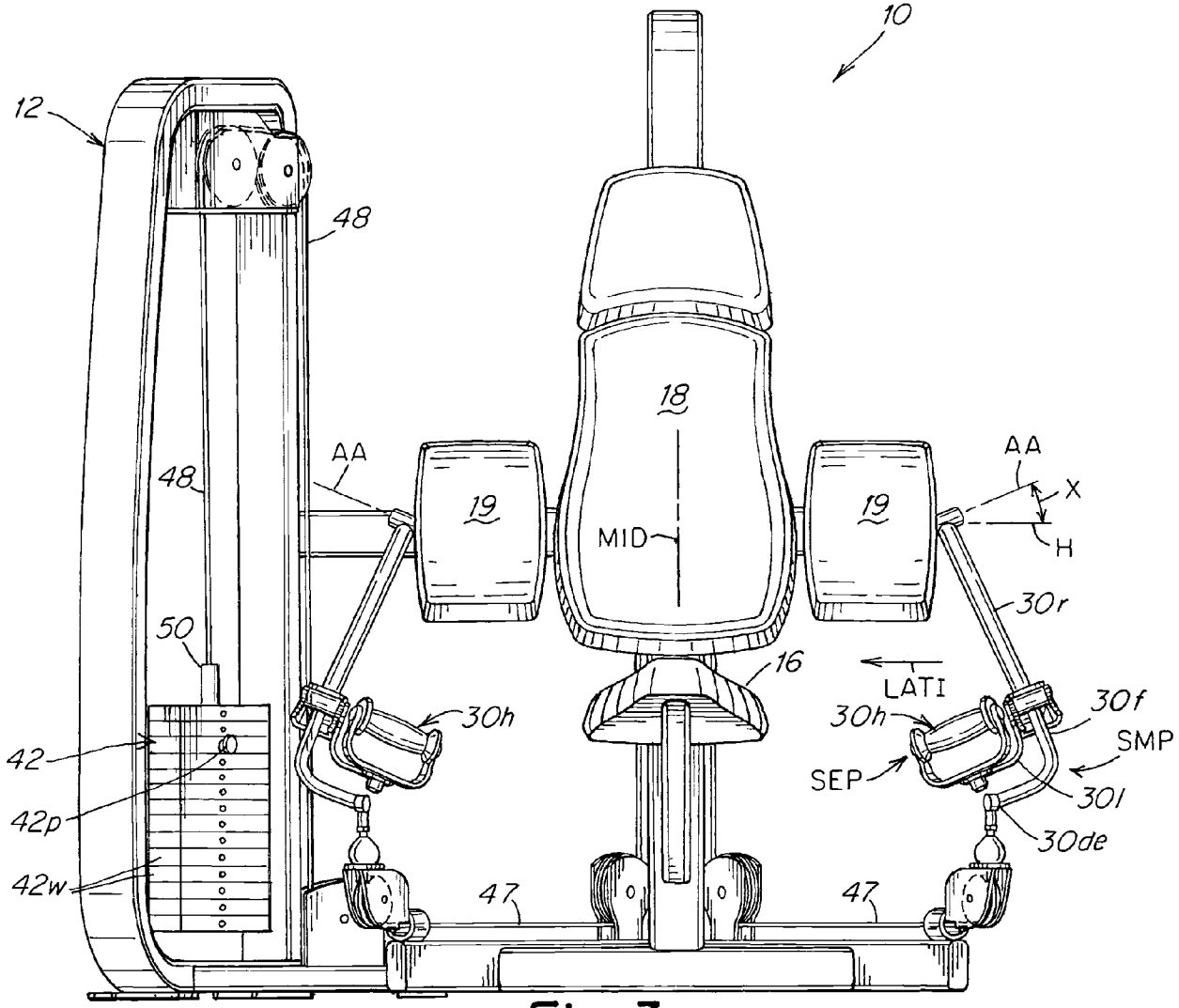
FIG. 3 is a front view of the FIG. 1 apparatus.
Figure 4:
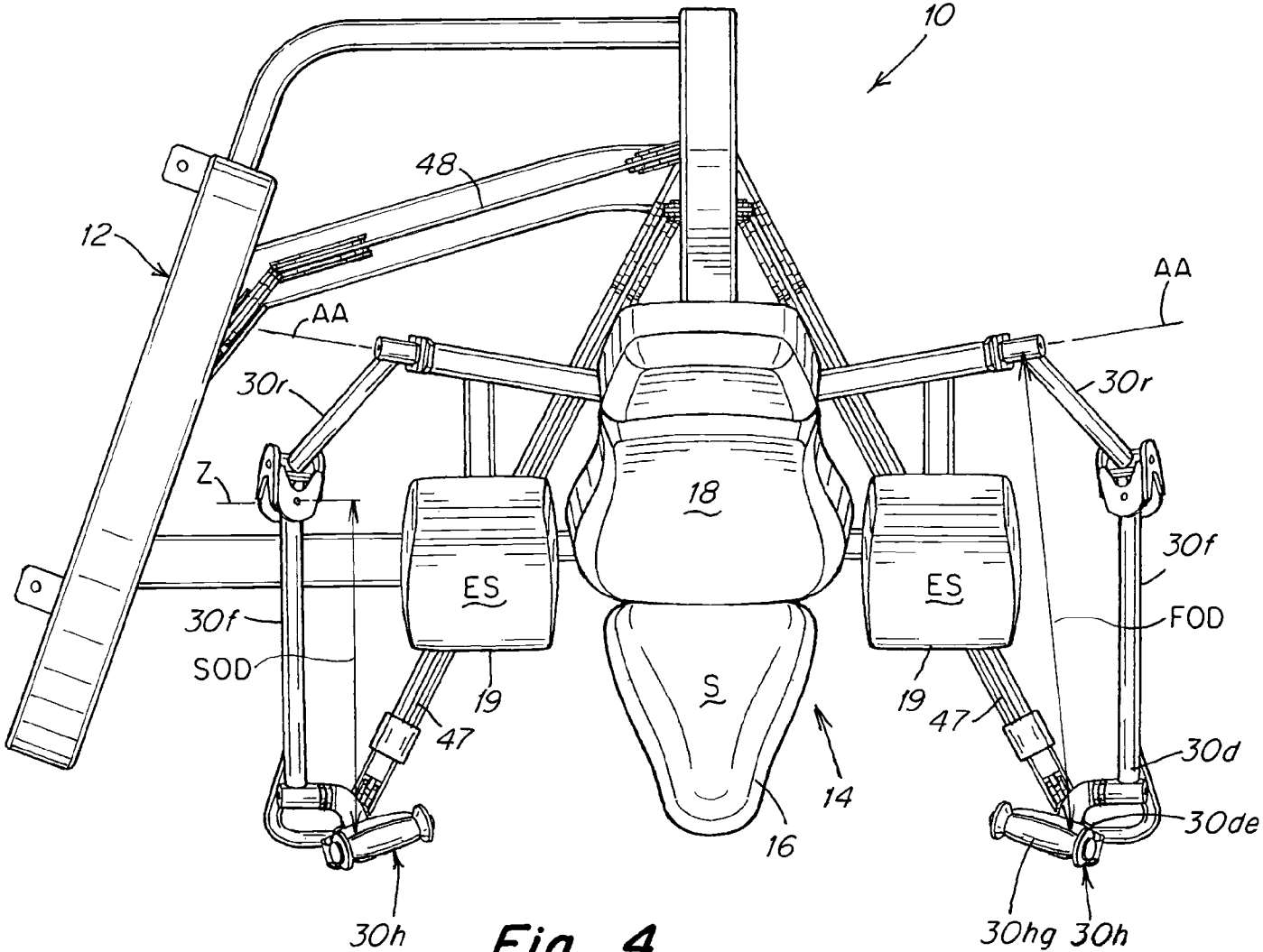
FIG. 4 is a top plan view of the FIG. 1 apparatus.
Figure 5A:
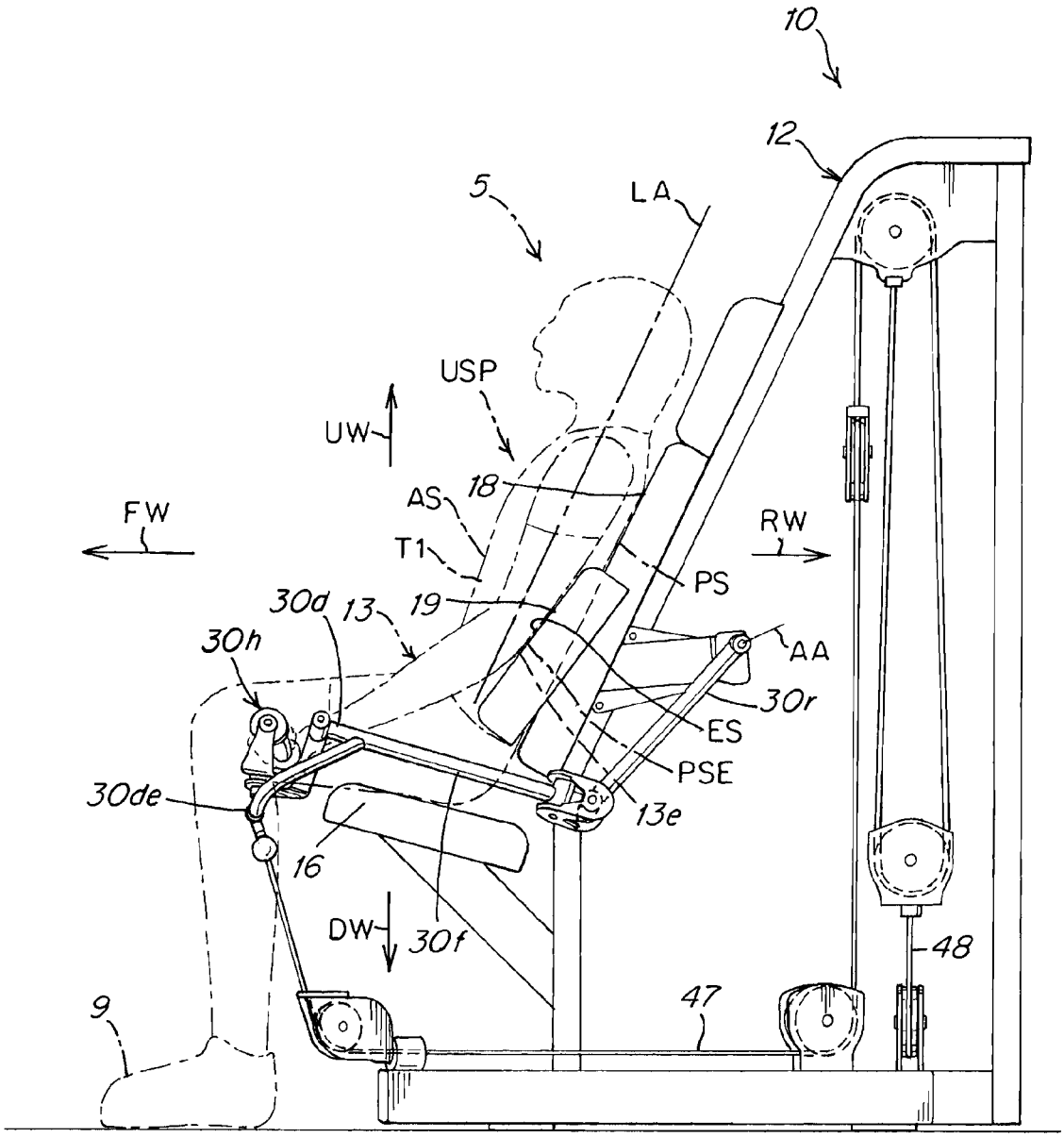
FIG. 5A is a schematic left side view of the FIG. 1 apparatus showing a user in a start exercise position.
Figure 5B:
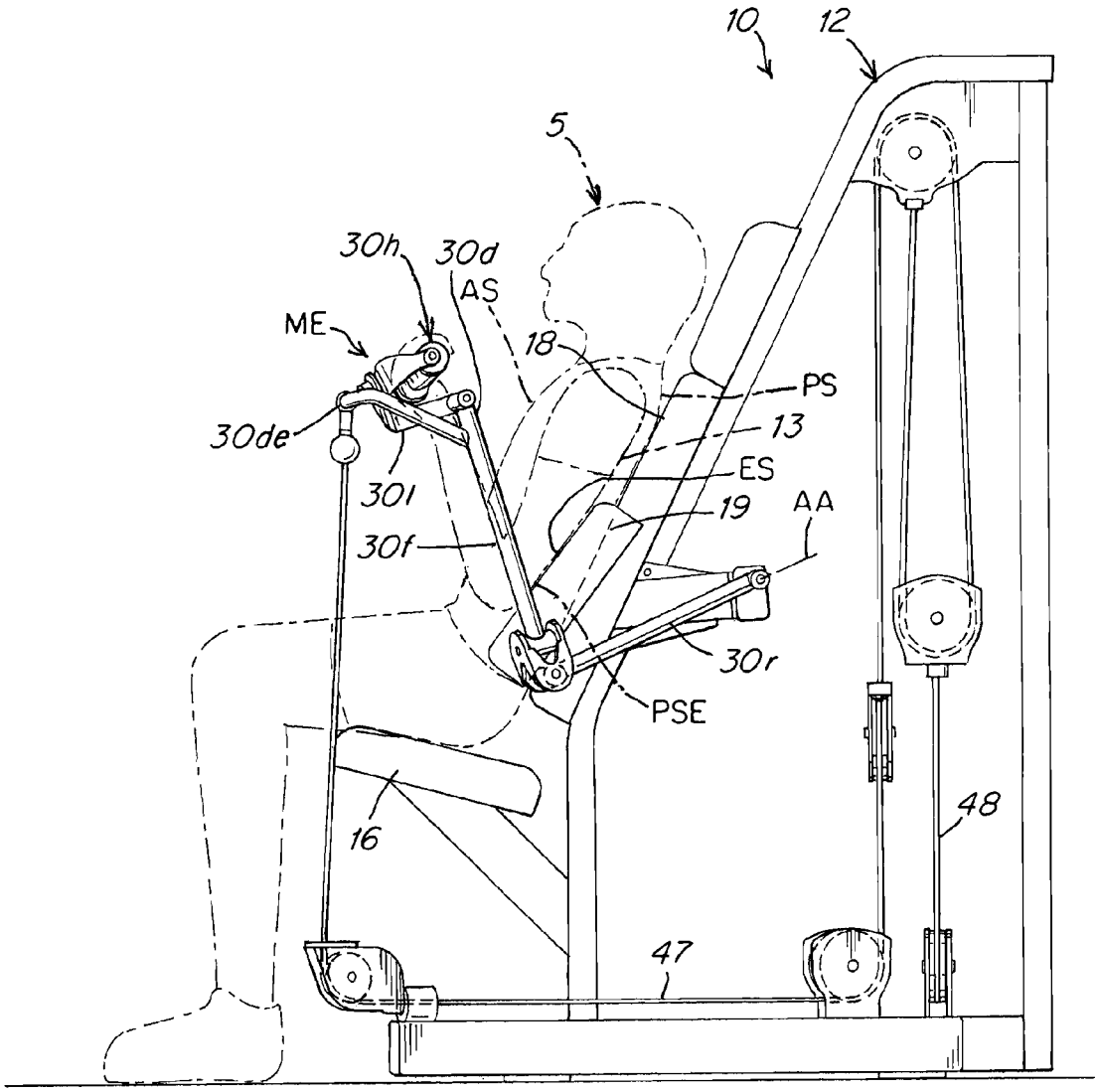
FIG. 5B is a view similar to FIG. 5A showing the user performing an arm curl exercise.
Figure 6A:
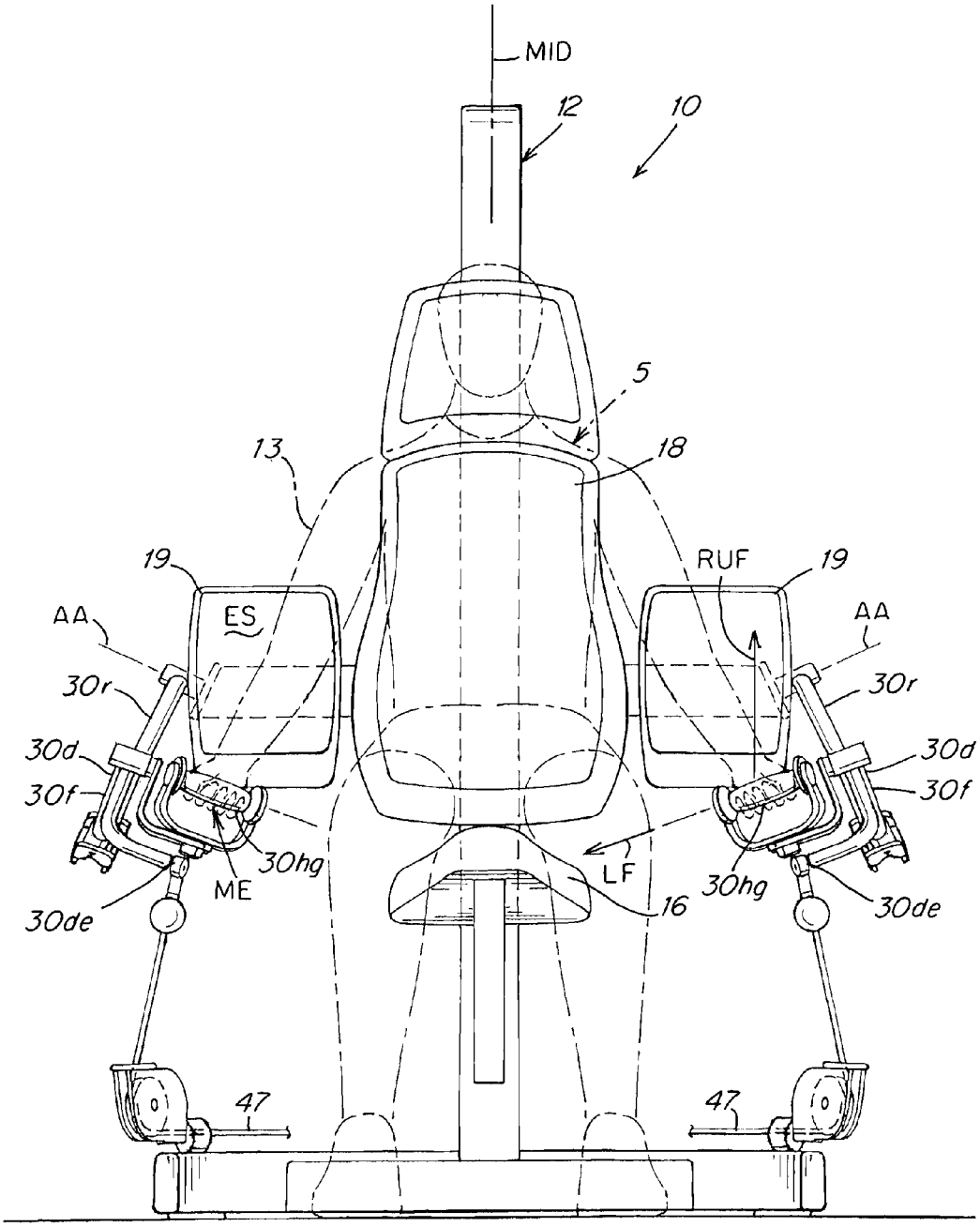
FIG. 6A is a schematic front view of the FIG. 1 apparatus showing a user in a start exercise position.
Figure 6B:
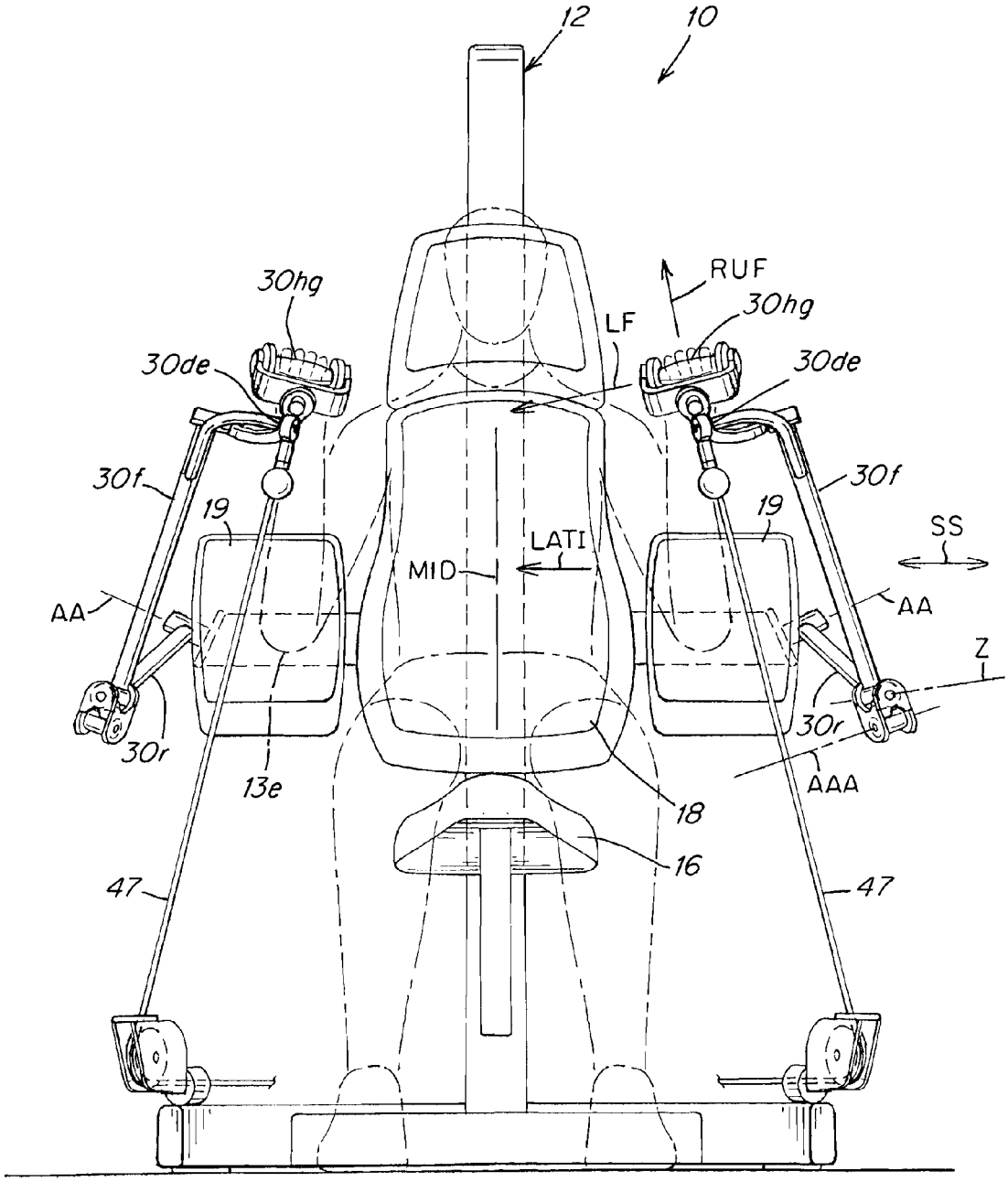
FIG. 6B is a schematic front view of the FIG. 1 apparatus showing a user performing an arm curl exercise.
Figure 7:
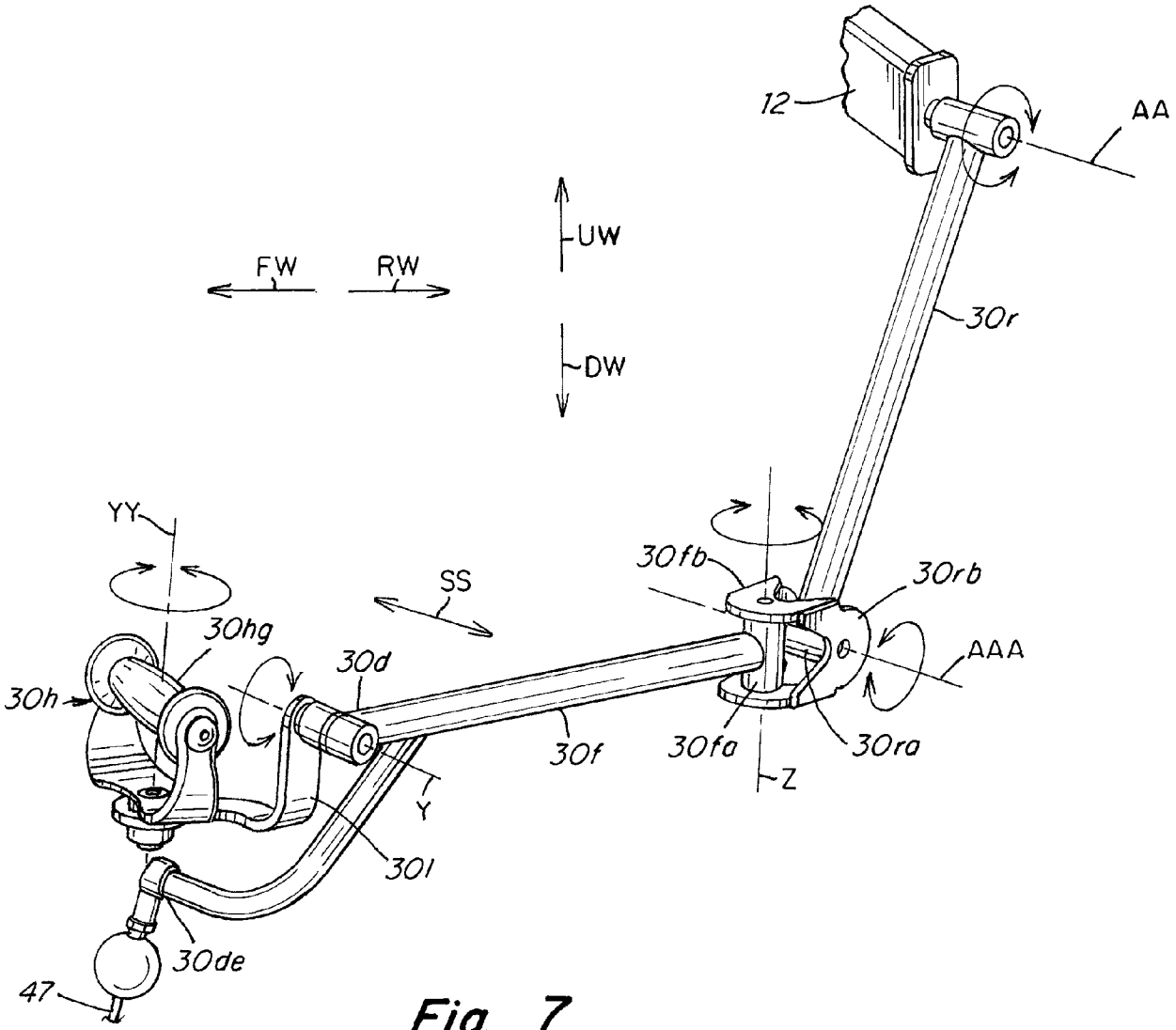
FIG. 7 is a left front fragmentary perspective view of an arm assembly of the FIG. 1 apparatus.

In an exemplary embodiment, as shown in FIGS. 1, 2 an arm curl apparatus 10 of the present invention includes a support frame 12 on which a user support structure 14 is mounted. The user support structure 14 includes a seat surface 16 and a back rest 18. The seat 16 is mounted on the frame 12 facing away from a pair of laterally disposed input arm assemblies 24 comprised of a pair of arm portions, a first arm portion 30*r* rotatably mounted to the frame for rotation around an axis AA disposed at an acute angle X relative to horizontal and a second arm portion 30*f* rotatably mounted to a distal end of the first arm portion for rotation around both a second axis AAA that is generally parallel to the axis AA and around a third axis Z that is generally perpendicular to axis AA.

The apparatus includes handles or manually graspable mechanisms 30*h* that are comprised of a link support 30I that is rotatably mounted for rotation around a fourth axis Y that is generally parallel to axis AA and a hand grip 30*hg* rotatable around a fifth axis YY that is generally perpendicular to axis Y to enable the user to readily rotate the handles 30*h* without resistance when pulling RUF, LF on the handles 30*h* to move the arms 30*r*, 30*f*.

The arms 30*r*, 30*f* are mounted to the frame 12 and are arranged and adapted so as to be interconnected via cable 47, 48 and pulley mechanisms to a weight resistance (in this embodiment a weight stack 42) that exerts an opposing resistance R1, R1*a* against pivoting of arms 30*r* and 30*f* around axes AA, AAA and Z. The weight stack 42 is selectively connectable to one end of a cable 48 by inserting a pin 42*p* in one of a plurality of holes in a lifting post 50 that passes vertically through the plates 42*w* as is well known in the art. For example, the weight stack 42 is formed by a stack of rectangular, brick-shaped plates 42*w*. Each plate 42*w* further has at least one horizontal channel or hole, wherein a pin 42*p* may be disposed to slidably engage any of a series of horizontal channels which are vertically oriented on the lifting post 50 in a spaced apart manner to match the vertical spacing of the stacked weight plates 42*w*. The pin 42*p* thereby engages a portion of the stack of weight plates 42*w*, such that when vertical force is applied to the lifting post 50, the selected stack of weight plates 42*w* is moved upwards to create a resistance R1, R1*a* to pivoting of arms 30*f*, 30*r* around axes AA, AAA and Z. Typically, the weight stack 42 apparatus is oriented such that the further down the pin is entered into the lifting post 50, the greater the number of plates 42*w* are engaged, thereby increasing the resistance R1 of the machine 10.

In alternative embodiments, other mechanisms for providing resistance, such as friction fittings, springs, elastic bands, pneumatic or electromagnetic resistance, or an air resistance fan could be employed (either alone or in combination) and still practice the invention. Additionally, free weights could be operably engaged to the transmission assembly to resist the movement.

The seat 16 is mounted on the frame 12 in a position relative to the ground such that a user can sit on the seat with the user's feet 9 touching the ground. The back rest 18 is mounted to the frame 12 relative to the seat 16 such that the user can engage the user's back PS against the back rest 18 when seated on the seat 16.

A pair of elbow pads 19 are mounted to the frame in a position or disposition that is space laterally away from a midline MID relative to the seat 16 and backrest 18 in an arrangement. The arrangement of the seat 16 and elbow pads 19 are adapted such that a user 5 seated on the seat 16 can engage the posterior surface PSE of the user's elbows against the engaging surface ES of the elbow pads 19 when seated without having to make any adjustments in vertical or horizontal positioning of the seat 16 and pads 19 regardless of the size or configuration of the user 5.

The input arm assembly 24 is comprised of a pair of pivotable arms 30*r*, 30*f* having a pair of handles 30*h* comprised of grips 30*hg* and handle links 30I mounted to a distal end 30*d* of the pivotable arms 30*f*. The arms 30*r*, 30*f* are mounted and adapted to dispose the grips 30*hg* and handles 30*h* in a start exercise or rest position SEP forwardly of FW and vertically below DW the point of engagement of the posterior surface PSE of the user's elbows with the engaging surface ES of the elbow pads 19 as well as the seat 16 surface S.

The anterior or front arm portion 30*f* of the assembly 24 is connected to the manually selectively adjustable weight resistance mechanism 42 via or through the posterior or rear arm portion 30*r*. As shown, the rear arm 30*r* is mounted to the frame 12*e* at a position that is disposed rearwardly RW of the front to rear position of the seat 16 and elbow pads 19. Rear arm 30*r* is pivotable around axis AA which as shown in the embodiments of FIGS. 1-7 is disposed at an angle X relative to horizontal H, FIG. 3 such that the path of travel of arm 30*r* on movement upwardly and rearwardly beginning from the start motionless position SMP is laterally inwardly LATI, FIGS. 6A, 6B toward the midline of the seat 16 and backrest 18 pivots. Similarly, front arm 30*f* is pivotable around both axis AA as well as an additional axis AAA that is generally parallel to axis AA. As shown front arm 30*f* is pivotably mounted on the forward distal end of arm 30*r*. Forward arm 30*f* is additionally pivotable around a separate axis Z formed by a dual axis hinge 30*fb*, 30*fa*, 30*rb*, 30*ra* mechanism such that front arm 30*f* is separately pivotable in the lateral SS direction enabling the user 5 to additionally pivot arm 30*f* laterally inwardly LATI around axis Z on applying lateral force LF when pulling the handles 30*h* rearwardly and upwardly RUF beginning from the start exercise SEP position of the handles 30*h*. Thus the arm assembly is comprised of an articulating arm assembly of arms 30*r* and 30*f* for pivoting around multiple axes AA, AAA and Z.

As shown, the input arm assembly 24 is interconnected to the resistance mechanism 42 at a point of interconnection 30*de* on the distal end of arm 30*f* that is spaced a first selected orthogonal distance FOD apart from the first linear axis AA selected to create a first selected torque resistance from the resistance mechanism against forward FW to rearward RW movement of the input arm assembly and is spaced a second selected orthogonal distance SOD from the third linear axis Z selected to create a second selected torque resistance from the resistance mechanism against lateral force LF and side to side SS movement of the second arm 30*f*. Thus in the arrangement shown, the handles 30*h* are maintained under resistance by interconnection of cable 47 at position 30*de* from moving away from the start exercise position SEP.

As shown the grips 30*hg* and handle links or brackets 30I are mounted on the distal ends 30*de* of the front articulating arm 30*f*. Grips are rotatable around axis YY and handle links 30I are separately rotatable around axis Y on the distal end of arm 30*f* so that the user 5 can freely rotate the user's wrist around both axes Y and YY on application force RUF in moving the handles 30*h* from the start position SEP rearwardly and upwardly as shown between FIGS. 6A and 6B.

As shown the distal end 30*de* of arm 30*f* is preferably connected to a proximal end of a cable 47 which is interconnected to the pole or manifold 50 of the resistance mechanism 42. The cable 47 interconnection to point 30*de* is independent of the hand grips 30*hg* and handle link 30I which are both pivotable around axes Y and YY without restriction from the resistance force R1, R1*a* that exerted by resistance 42 through the cable 47 interconnection.

The seat 16, the back rest 18 and the elbow pads 19 are configured to be of such a size and disposition relative to each other and relative to the arrangement of the arms 30*r*, 30*f* such that the seat 16 and elbow pads 19 are fixedly mounted to the frame 12 and preferably do not require adjustment by a user regardless of size, shape or configuration of the user.

The first arm portion 30*a* of the arms is pivotably mounted to the frame for rotation around axis AA at an acute angle X relative to horizontal of between about 20 degrees and about 75 degrees.

What is claimed is:

1. Apparatus for performing an arm curl exercise by a user having a trunk (T1) having a longitudinal axis (LA), opposing anterior (AS) and posterior (PS) sides and an arm with elbow extending from the trunk (T1), the apparatus comprising:

a frame, a seat having a seating surface, an elbow pad having an engaging surface (ES), an input arm assembly interconnected to a resistance mechanism and a manually graspable mechanism, the input arm assembly being pivotably mounted on the frame for back and forth travel along a generally upward (UW) to downward (DW) and forward (FW) to rearward (RW) direction, the input arm assembly being adapted to reside in a start motionless position (SMP) relative to a selected arrangement of the seat and elbow pad, the seat (16) and elbow pad being arranged relative to the input arm assembly to position the user in a user start position (USP) that enables the user to manually engage the manually graspable mechanism when the user is seated in an orientation where a posterior surface (PSE) of the user's elbow user's elbow is engaged with the engaging surface (ES) of the elbow pad and the anterior side of the user's trunk faces in a generally forward (FW) direction, the input arm assembly comprising a first arm being rotatably pivotable around a first linear axis (AA) starting from the start exercise position (SEP) through a generally forward to rearward or downward to upward path of travel under resistance (R1) exerted by the resistance mechanism on application of upwardly or rearwardly directed force (RUF) by the user on the manually graspable mechanism, the input arm assembly comprising a second arm interconnected to the resistance mechanism at a point of interconnection on a distal end of said second arm and rotatably pivotable around a second linear axis (AAA) along a generally forward to rearward or downward to upward path of travel under resistance (R1) exerted by the resistance mechanism on application of upwardly or rearwardly directed force (RUF) by the user (5) on the manually graspable mechanism.

2. The apparatus of claim 1 wherein the seat, elbow pad and arm assembly are arranged on the apparatus such that the first linear axis (AA) of pivoting of the arms is disposed rearwardly (RW) of the user's trunk (T1) when the user is seated on the seating surface (S) and the posterior surface (PSE) of the user's elbow is engaged with the engaging surface (ES).

3. The apparatus of claim 1 wherein the second arm is pivotable around a third linear axis (Z) along a generally lateral or side to side (SS) path of travel.

4. The apparatus of claim 3 wherein the second arm is pivotable around the third linear axis (Z) under resistance (R1*a*) exerted by the resistance mechanism on application of generally laterally directed force (LF) by the user on the manually graspable mechanism starting from the start exercise position (SEP).

5. The apparatus of claim 1 wherein the manually graspable mechanism comprises a handle link pivotably mounted to the second arm for separate rotation around a handle axis (Y).

6. The apparatus of claim 1 wherein the manually graspable mechanism includes a grip pivotably mounted to the handle link for separate rotation around a grip axis (YY).

7. The apparatus of claim 3 wherein the input arm assembly is interconnected to the resistance mechanism at a point of interconnection of the input arm assembly that is spaced a first selected orthogonal distance (FOD) apart from the first linear axis (AA) selected to create a first selected torque resistance from the resistance mechanism against forward (FW) to rearward (RW) movement of the input arm assembly and is spaced a second selected orthogonal distance (SOD) from the third linear axis (Z) selected to create a second selected torque resistance from the resistance mechanism against lateral or side to side (SS) movement of the second arm.

8. The apparatus of claim 7 wherein the first selected orthogonal distance is greater than the second selected orthogonal distance.

9. The apparatus of claim 1 wherein the input arm assembly is adapted such that in the start motionless position (SMP) the manually graspable mechanism is disposed in a start exercise position (SEP) vertically below and forwardly of a point of engagement (PSE) of the user's elbow (13*e*) with the engaging surface (ES) when the user is seated on the seating surface (S) in an orientation where the anterior surface (AS) of the user's trunk (T1) is facing generally forwardly (FW).

10. The apparatus of claim 1 wherein the first linear axis (AA) and second linear axis (AAA) are disposed generally parallel relative to each other.

11. The apparatus of claim 3 wherein the first linear axis (AA) and the third linear axis (Z) are disposed generally orthogonal to each other.

12. The apparatus of claim 3 wherein the second linear axis (AAA) and the third linear axis (Z) are disposed generally orthogonal to each other.

13. The apparatus of claim 1 wherein the seat is selectively adjustable in vertical position relative to the manually graspable mechanism.

14. The apparatus of claim 1 wherein the first arm is interconnected to a bracket (30*rb*) that pivots around the second linear axis (AAA) on a first axle, the first axle being attached to a second axle that is attached to the second arm and pivots about the third linear axis (Z) on a second bracket.

15. The apparatus of claim 10 wherein the first axle is fixedly interconnected to the second axle.

16. A method of performing an arm curl exercise comprising:

a user being seated on the seat of the exercise apparatus of claim 1 in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a rearwardly or upwardly directed force (RUF) on the manually graspable mechanism against resistance from the resistance mechanism.

17. A method of performing a pull down exercise comprising:

a user being seated on the seat of the exercise apparatus of claim 3 in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a laterally or side to side directed force (LF) on the manually graspable mechanism against resistance from the resistance mechanism.

18. Apparatus for performing a pull down exercise by a user having a trunk (T1) having a longitudinal axis (LA), opposing anterior (AS) and posterior (PS) sides and an arm with elbow extending from the trunk (T1), the apparatus comprising:

a frame, a seat having a seating surface (S), an elbow pad having an engaging surface (ES), an input arm assembly interconnected to a resistance mechanism and a manually graspable mechanism, the input arm assembly being pivotably mounted on the frame for back and forth travel along a generally upward (UW) to downward (DW) and forward (FW) to rearward (RW) direction, the input arm assembly being adapted to reside in a start motionless position (SMP) relative to a selected arrangement of the seat and elbow pad that disposes the manually graspable mechanism in a start exercise position (SEP) that is disposed vertically below and forwardly of the user's elbow when the user is seated on the seating surface (S) in an orientation where the anterior surface (AS) of the user's trunk (T1) is facing generally forwardly (FW), the seat and elbow pad being arranged relative to the input arm assembly to position the user in a user start position (USP) that enables the user to manually engage the manually graspable mechanism when the user is seated in an orientation where a posterior surface (PSE) of the user's elbow user's elbow is engaged with the engaging surface (ES) of the elbow pad and the anterior and posterior sides of the user's trunk are oriented in a generally forward (FW) to rearward (RW) direction, the input arm assembly comprising a first arm being rotatably pivotable around a first linear axis (AA) starting from the start exercise position (SEP) through a generally forward to rearward or downward to upward path of travel under resistance (R1) exerted by the resistance mechanism on application of upwardly or rearwardly directed force (RUF) by the user on the manually graspable mechanism, the input arm assembly comprising a second arm interconnected to the resistance mechanism at a point of interconnection on a distal end of said second arm and pivotable around a third linear axis (Z) along a generally lateral or side to side (SS) path of travel.

19. The apparatus of claim 18 wherein the seat, elbow pad and arm assembly are arranged on the apparatus such that the first linear axis (AA) of pivoting of the arms is disposed rearwardly (RW) of the user's trunk (T1) when the user is seated on the seating surface (S) and the posterior surface (PSE) of the user's elbow is engaged with the engaging surface (ES).

20. The apparatus of claim 18 wherein the second arm is pivotable around a second linear axis (AAA) along a generally forward to rearward or downward to upward path of travel under resistance (R1) exerted by the resistance mechanism on application of upwardly or rearwardly directed force (RUF) by the user on the manually graspable mechanism.

* * * * *